US010714255B2

(12) United States Patent
Hashimoto

(10) Patent No.: US 10,714,255 B2
(45) Date of Patent: Jul. 14, 2020

(54) COMMON MODE CHOKE COIL

(71) Applicant: MURATA MANUFACTURING CO., LTD., Kyoto-fu (JP)

(72) Inventor: Ryota Hashimoto, Kyoto-fu (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 7 days.

(21) Appl. No.: 14/823,385

(22) Filed: Aug. 11, 2015

(65) Prior Publication Data

US 2016/0111204 A1 Apr. 21, 2016

(30) Foreign Application Priority Data

Oct. 17, 2014 (JP) ..... 2014-212615

(51) Int. Cl.
*H01F 27/29* (2006.01)
*H01F 17/04* (2006.01)
*H01F 17/00* (2006.01)

(52) U.S. Cl.
CPC ..... *H01F 27/29* (2013.01); *H01F 17/045* (2013.01); *H01F 2017/0093* (2013.01)

(58) Field of Classification Search
CPC ..... H01F 27/29; H01F 27/006; H01F 17/045; H01F 2017/0093
See application file for complete search history.

(56) References Cited

U.S. PATENT DOCUMENTS 6,373,366 B1 * 4/2002 Sato ..... H01F 17/045 336/192
6,472,969 B1 * 10/2002 Hanato ..... H01F 17/045 336/192
2002/0057160 A1 * 5/2002 Hanato ..... H01F 27/027 336/83
2005/0052267 A1 * 3/2005 Singu ..... H01F 27/292 336/83
2007/0129043 A1 * 6/2007 Vieira ..... H01F 17/06 455/326
2009/0219127 A1 * 9/2009 Tomonari ..... H01F 27/29 336/192
2010/0109827 A1 * 5/2010 Asou ..... H01F 41/076 336/192

(Continued)

FOREIGN PATENT DOCUMENTS

CN 1334572 A 2/2002
JP 2004-273490 A 9/2004

(Continued)

OTHER PUBLICATIONS

Notification of the Second Office Action issued by the State Intellectual Property Office of the People's Republic of China dated Nov. 6, 2017, which corresponds to Chinese Patent Application No. 201510632140.5 and is related to U.S. Appl. No. 14/823,385.

*Primary Examiner* — Elvin G Enad
*Assistant Examiner* — Malcolm Barnes
(74) *Attorney, Agent, or Firm* — Studebaker & Brackett PC

(57) ABSTRACT

A common mode choke coil includes a core and a first winding, a second winding, and a third winding that are wrapped around the core. A number of turns in the third winding is less than a number of turns in the first winding and a number of turns in the second winding.

3 Claims, 8 Drawing Sheets

(56) References Cited

U.S. PATENT DOCUMENTS

| | | | | |
|---|---|---|---|---|
| 2012/0223797 | A1* | 9/2012 | Won | H01F 27/306 336/170 |
| 2014/0292465 | A1* | 10/2014 | Takagi | H01F 27/292 336/192 |
| 2014/0292467 | A1* | 10/2014 | Tai | H01F 27/24 336/192 |
| 2015/0345998 | A1* | 12/2015 | Lamesch | B60N 2/5685 324/686 |

FOREIGN PATENT DOCUMENTS

| | | | |
|---|---|---|---|
| JP | 3952971 | B2 | 8/2007 |
| WO | 2014/096127 | A1 | 6/2014 |

* cited by examiner

COMMON MODE CHOKE COIL

CROSS-REFERENCE TO RELATED APPLICATION

This application claims benefit of priority to Japanese Patent Application No. 2014-212615 filed Oct. 17, 2014, the entire content of which is incorporated herein by reference.

BACKGROUND

1. Technical Field

The present disclosure relates to a common mode choke coil, and particularly relates to a common mode choke coil having three windings.

2. Description of the Related Art

The wound-type common mode choke coil disclosed in Japanese Patent No. 3952971 is known as an example of a conventional common mode choke coil. This common mode choke coil is configured with three wires wound around a core so as to form three coils (a first coil to a third coil). FIG. 9 is a circuit diagram illustrating a transmission/reception system in which a wound-type common mode choke coil 110 disclosed in Japanese Patent No. 3952971 is applied.

As illustrated in FIG. 9, the common mode choke coil 110 is provided between a transmission circuit 120 and a reception circuit 122. Specifically, a first coil 112 is connected partway along a signal line 123 that connects the transmission circuit 120 and the reception circuit 122, a second coil 114 is connected partway along a signal line 124 that connects the transmission circuit 120 and the reception circuit 122, and a third coil 116 is connected partway along a ground line 126 that connects the transmission circuit 120 and the reception circuit 122.

In this transmission/reception system, transmission signals Sig1 and Sig2 are transmitted from the transmission circuit 120 to the reception circuit 122 through the signal lines 123 and 124, respectively. In this case, the transmission signals Sig1 and Sig2 are transmitted from the reception circuit 122 to the transmission circuit 120 through the ground line 126. As a result, the orientation of a magnetic field generated by the first coil 112 and the orientation of a magnetic field generated by the second coil 114 are opposite to the orientation of a magnetic field generated by the third coil 116. In other words, the magnetic fields generated by the first coil 112 and the second coil 114 and the magnetic field generated by the third coil 116 cancel each other out. As a result, a magnetic flux density in the core is suppressed from becoming too high, and magnetic saturation is suppressed. In other words, the common mode choke coil disclosed in Japanese Patent No. 3952971 has excellent DC superposition characteristics.

However, according to the common mode choke coil disclosed in Japanese Patent No. 3952971, it is difficult to increase a rated current value. More specifically, a larger current flows in the third coil 116 than in the first coil 112 and the second coil 114. The first coil 112, the second coil 114, and the third coil 116 have the same number of turns, and thus the first coil 112, the second coil 114, and the third coil 116 have the same resistance value. Accordingly, the third coil 116 is more prone to emitting heat than the first coil 112 and the second coil 114. For this reason, the rated current value of the common mode choke coil is determined by an upper limit value of the current that can be flowed through the third coil 116. As a result, even if a current that is smaller than the rated current value is flowing in the first coil 112 and the second coil 114, when a current equal to the rated current value flows in the third coil 116, a larger current than the presently flowing current cannot be flowed through the first coil 112 and the second coil 114. In other words, according to the common mode choke coil disclosed in Japanese Patent No. 3952971, it is difficult to increase the rated current value.

SUMMARY

Accordingly, it is an object of the present disclosure to provide a common mode choke coil capable of increasing a rated current value.

A common mode choke coil according to an aspect of the present disclosure includes a core and a first winding, a second winding, and a third winding that are wrapped around the core. A number of turns in the third winding is less than a number of turns in the first winding and a number of turns in the second winding.

According to the present disclosure, a rated current value can be increased.

Other features, elements, characteristics and advantages of the present disclosure will become more apparent from the following detailed description of preferred embodiments of the present disclosure with reference to the attached drawings.

DETAILED DESCRIPTION

Configuration of Common Mode Choke Coil

Figure 1:
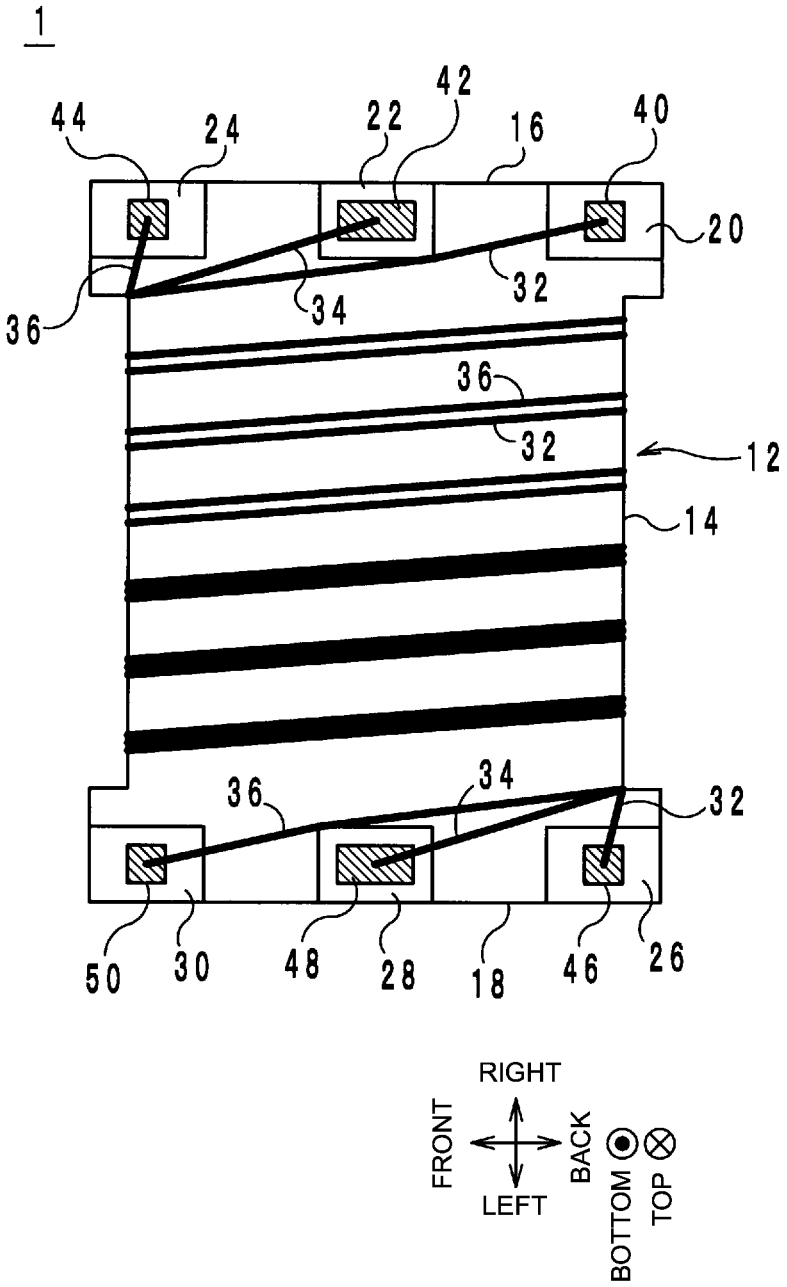
FIG. 1 is a diagram illustrating a common mode choke coil in plan view from below.
Figure 2:
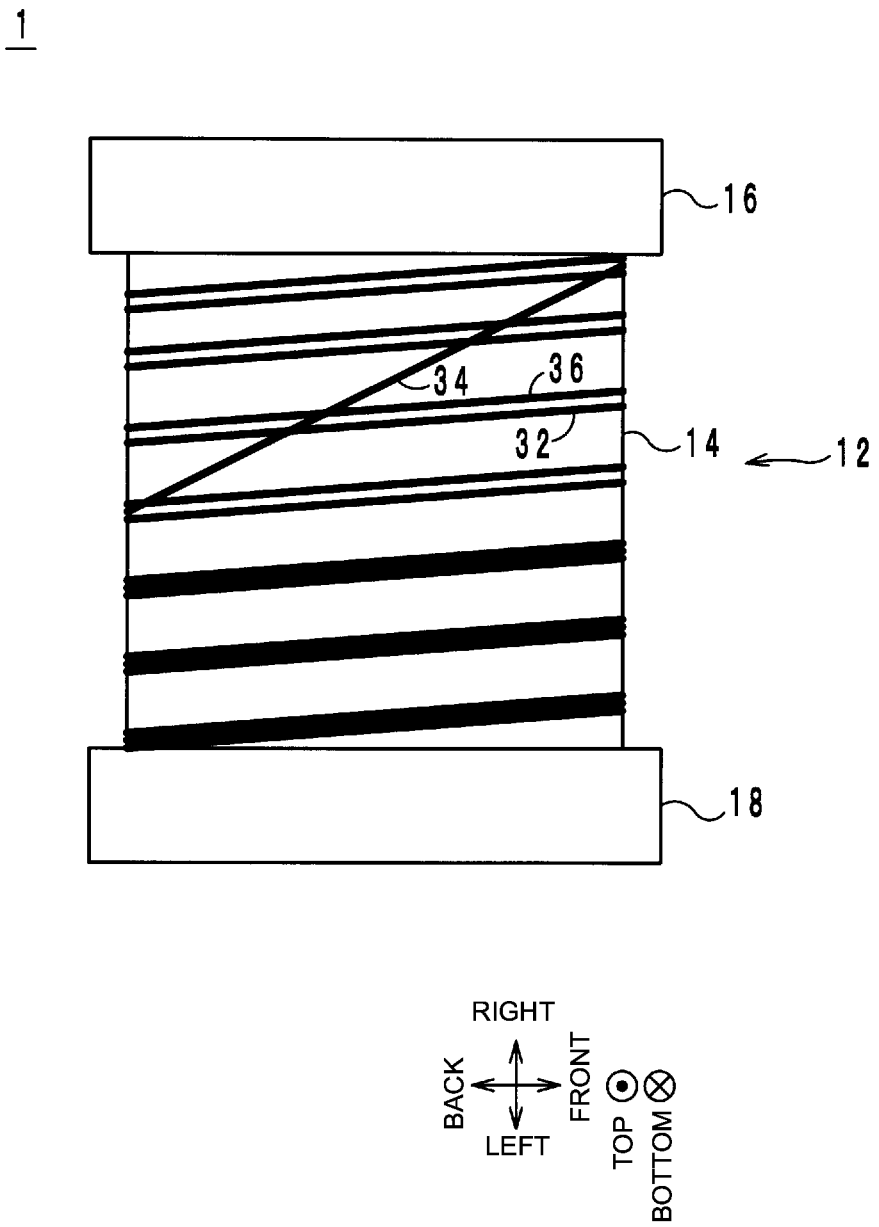
FIG. 2 is a diagram illustrating the common mode choke coil in plan view from above.
Figure 3:
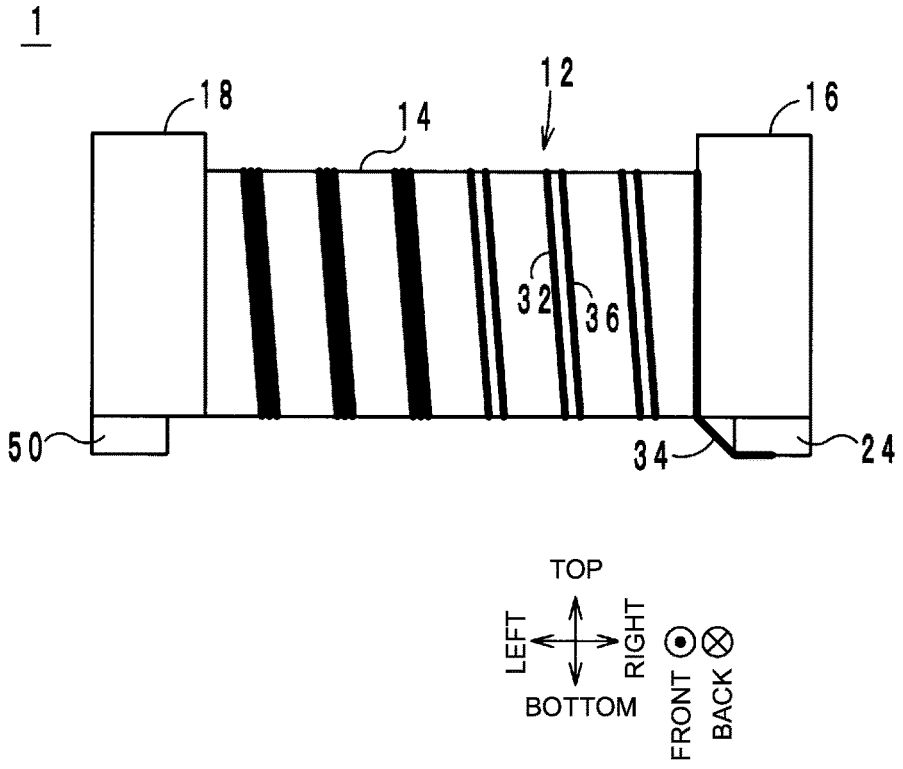
FIG. 3 is a diagram illustrating the common mode choke coil in plan view from the front.

Hereinafter, a common mode choke coil according to an embodiment of the present disclosure will be described with reference to the drawings. FIG. 1 is a diagram illustrating a common mode choke coil 1 in plan view from below. FIG. 2 is a diagram illustrating the common mode choke coil 1 in plan view from above. FIG. 3 is a diagram illustrating the common mode choke coil 1 in plan view from the front. In the following, a direction in which a center axis of a core portion 14 extends is defined as a left-right direction. In addition, when taken in plan view from a right side, a direction along a long side of a flange portion 16 is defined as a front-back direction, and a direction along a short side of the flange portion 16 is defined as a top-bottom direction.

As illustrated in FIG. 1, the common mode choke coil 1 includes the core 12, windings 32, 34, and 36, and outer electrodes 40, 42, 44, 46, 48, and 50.

The core 12 is formed of a magnetic material such as ferrite, alumina, or the like, and includes the core portion 14, the flange portion 16 and a flange portion 18, and electrode forming portions 20, 22, 24, 26, 28, and 30.

The core portion 14 is a substantially quadrangular column-shaped member that extends in the left-right direction. However, the core portion 14 is not limited to a substantially quadrangular column shape, and may be substantially cylindrical.

The flange portion 16 has a substantially rectangular parallelepiped shape, and is provided at a right end of the core portion 14. The flange portion 18 has a substantially rectangular parallelepiped shape, and is provided at a left end of the core portion 14. The flange portions 16 and 18 protrude upward, forward, and backward from the core portion 14.

The electrode forming portions 20, 22, and 24 are provided on a bottom surface of the flange portion 16, and are arranged in that order from a back side to a front side. The electrode forming portions 20, 22, and 24 are substantially quadrangular column-shaped members that protrude downward from the bottom surface of the flange portion 16.

The electrode forming portions 26, 28, and 30 are provided on a bottom surface of the flange portion 18, and are arranged in that order from a back side to a front side. The electrode forming portions 26, 28, and 30 are substantially quadrangular column-shaped members that protrude downward from the bottom surface of the flange portion 18.

The outer electrodes 40, 42, and 44 are provided on bottom surfaces of the electrode forming portions 20, 22, and 24, respectively, and are terminals used to connect the common mode choke coil 1 to an external circuit. The outer electrodes 46, 48, and 50 are provided on bottom surfaces of the electrode forming portions 26, 28, and 30, respectively, and are terminals used to connect the common mode choke coil 1 to an external circuit. When viewed in plan view from below, the outer electrodes 40, 42, 44, 46, 48, and 50 have substantially rectangular shapes. However, the outer electrode 42 has a greater surface area than the surface area of the outer electrodes 40 and 44. Likewise, the outer electrode 48 has a greater surface area than the surface area of the outer electrodes 46 and 50. The outer electrodes 40, 42, 44, 46, 48, and 50 are formed from a Ni-based alloy such as Ni—Cr, Ni—Cu, Ni, or the like, or from Ag, Cu, Sn, or the like.

The windings 32, 34, and 36 are conducting wires formed by covering core wires that take a conductive material such as copper, silver, or the like as a primary component with an insulative material such as polyurethane. The windings 32, 34, and 36 are wrapped around the core portion 14. Specifically, the windings 32, 34, and 36 are wrapped around the outside of the core portion 14 so that, when viewed in plan view from the right side, the windings 32, 34, and 36 have a substantially spiral shape that advances from the left side to the right side while encircling the core portion 14 in a counter-clockwise direction. The winding 32 and the winding 36 run parallel to each other across the entire length of the core portion 14. However, the winding 34 runs parallel to the windings 32 and 36 on a left half of the core portion 14, but does not run parallel to the windings 32 and 36 on a right half of the core portion 14. On the right half of the core portion 14, the winding 34 extends substantially linearly from a top surface of the core portion 14 to a right end thereof. As such, the winding 32 and the winding 36 have the same number of turns, namely seven. However, the winding 34 has a lower number of turns than the windings 32 and 36, namely four. As a result, a resistance value of the winding 34 is lower than resistance values of the windings 32 and 36.

A right end of the winding 32 is connected to the outer electrode 40, and a left end of the winding 32 is connected to the outer electrode 46. A right end of the winding 34 is connected to the outer electrode 42, and a left end of the winding 34 is connected to the outer electrode 48. A right end of the winding 36 is connected to the outer electrode 44, and a left end of the winding 36 is connected to the outer electrode 50.

Operations of the common mode choke coil 1 configured as described above will be described next. A transmission signal Sig11 flows in the winding 32, and a transmission signal Sig12 flows in the winding 36. In the case where the transmission signals Sig11 and Sig12 include a common mode signal, the winding and the winding 36 generate magnetic fields in the same direction due to the common mode signal. In other words, the magnetic field generated by the winding 32 due to the common mode signal and the magnetic field generated by the winding 36 due to the common mode signal strengthen each other. Accordingly, a strong magnetic field is generated in each of the windings 32 and due to the common mode signal, and the windings 32 and 36 attempt to suppress changes in that magnetic field with electromagnetic induction. The common mode signal is prevented from passing through the windings 32 and 36 as a result.

On the other hand, in the case where the transmission signals Sig11 and Sig12 include a normal mode signal, the winding and the winding 36 generate magnetic fields in opposite directions due to the normal mode signal. In other words, the magnetic field generated by the winding 32 due to the normal mode signal and the magnetic field generated by the winding 36 due to the normal mode signal weaken each other. Accordingly, a strong magnetic field is not produced in the windings 32 and 36 due to the normal mode signal, and almost no electromagnetic induction is produced in the windings 32 and 36. The normal mode signal can pass through the windings 32 and 36 as a result.

Figure 4:
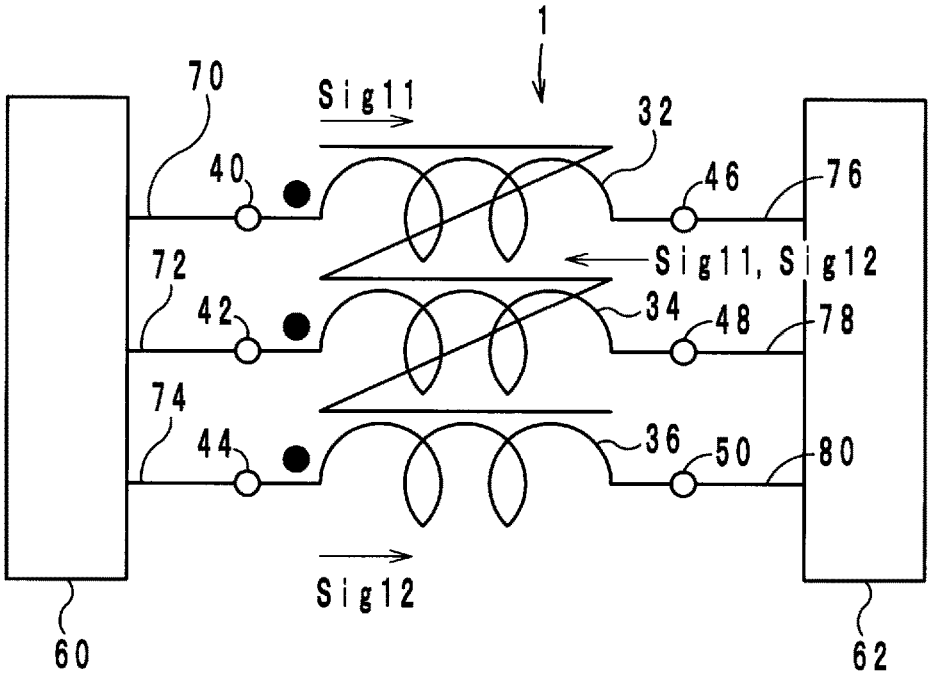
FIG. 4 is a circuit diagram illustrating a transmission/reception system in which the common mode choke coil has been applied.

The common mode choke coil 1 configured as described above is used as described hereinafter. Descriptions will be given below with reference to the drawings. FIG. 4 is a circuit diagram illustrating a transmission/reception system in which the common mode choke coil 1 has been applied.

As illustrated in FIG. 4, the common mode choke coil 1 is provided between a transmission circuit 60 and a reception circuit 62. Specifically, signal lines 70 and 74 and a ground line 72 are connected to the transmission circuit 60. Signal lines 76 and 80 and a ground line 78 are connected to the reception circuit 62.

The outer electrode 40 is connected to the signal line 70, and the outer electrode 46 is connected to the signal line 76. As a result, the winding 32 is connected between the signal line 70 and the signal line 76.

The outer electrode 42 is connected to the ground line 72, and the outer electrode 48 is connected to the ground line 78. As a result, the winding 34 is connected between the ground line 72 and the ground line 78.

The outer electrode 44 is connected to the signal line 74, and the outer electrode 50 is connected to the signal line 80. As a result, the winding 36 is connected between the signal line 74 and the signal line 80.

In this transmission/reception system, a transmission signal Sig11 is transmitted from the transmission circuit 60 to the reception circuit 62 through the signal lines 70 and 76 and the winding 32. Meanwhile, a transmission signal Sig12 is transmitted from the transmission circuit 60 to the reception circuit 62 through the signal lines 74 and 80 and the winding 36. In this case, the transmission signals Sig11 and Sig12 are transmitted from the reception circuit 62 to the transmission circuit 60 through the ground lines 72 and 78 and the winding 34. As a result, the orientation of the magnetic field generated by the winding 32 and the orientation of the magnetic field generated by the winding 36 are opposite to the orientation of a magnetic field generated by the winding 34. In other words, the magnetic fields generated by the windings 32, 34, and 36 cancel each other out. As a result, a magnetic flux density in the core 12 is suppressed from becoming too high, and magnetic saturation is suppressed. In other words, the common mode choke coil 1 has superior DC superposition characteristics.

Effects

According to the common mode choke coil 1 configured as described above, a rated current value can be increased. More specifically, according to the common mode choke coil disclosed in Japanese Patent No. 3952971, a greater current flows in the third coil 116 than in the first coil 112 and the second coil 114. The first coil 112, the second coil 114, and the third coil 116 have the same number of turns, and thus the first coil 112, the second coil 114, and the third coil 116 have the same resistance value. Accordingly, the third coil 116 is more prone to emitting heat than the first coil 112 and the second coil 114. For this reason, the rated current value of the common mode choke coil is determined by an upper limit value of the current that can be flowed through the third coil 116. As a result, even if a current that is smaller than the rated current value is flowing in the first coil 112 and the second coil 114, when a current equal to the rated current value flows in the third coil 116, a larger current than the presently flowing current cannot be flowed through the first coil 112 and the second coil 114. In other words, according to the common mode choke coil disclosed in Patent Document 1, it is difficult to increase the rated current value.

However, according to the common mode choke coil 1, the winding 34 has a lower number of turns than the windings 32 and 36. As such, the resistance value of the winding 34, which is relatively more prone to emitting heat, is lower than the resistance values of the windings 32 and 36, which are less prone to emitting heat. Accordingly, the winding 34 is suppressed from emitting heat and the upper limit value of a current than can be flowed through the winding 34 increases. As a result, according to the common mode choke coil 1, the rated current value can be increased.

Figure 5:
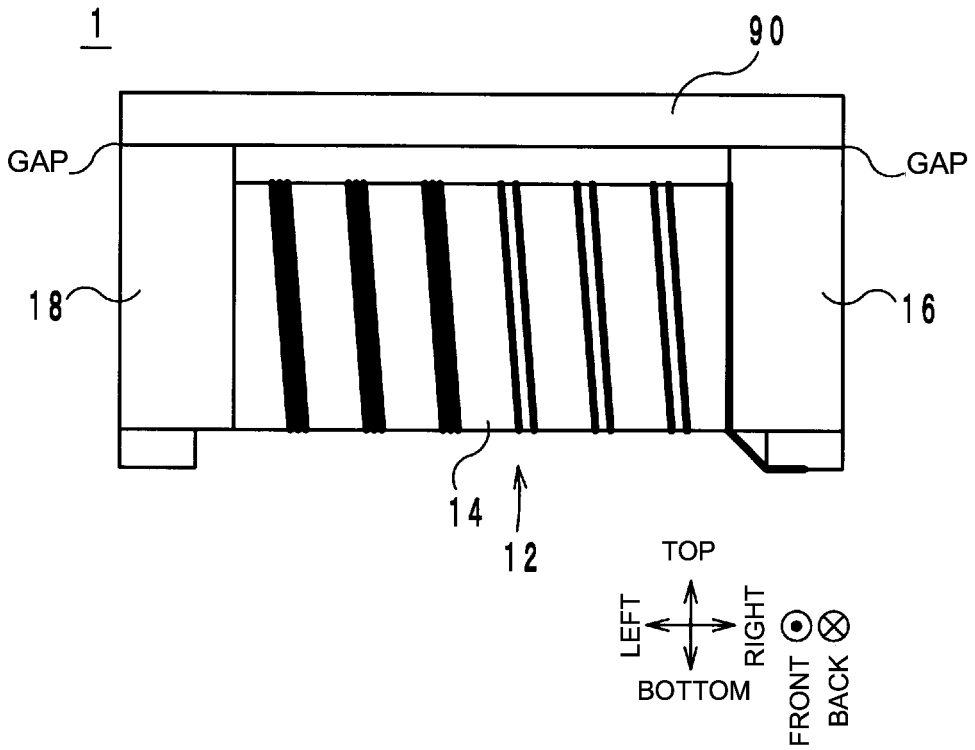
FIG. 5 is a diagram illustrating a core and a top plate core of the common mode choke coil used in a first experiment.

Here, the inventors of the present disclosure carried out a first experiment, described hereinafter, in order to find a preferable number of turns for the winding 34 in the common mode choke coil 1. FIG. 5 is a diagram illustrating the core 12 and a top plate core 90 of the common mode choke coil 1 used in the first experiment.

The inventors of the present disclosure varied the number of turns in the winding 34 from one to seven while keeping the number of turns of the windings 32 and 36 at seven, and examined the DC superposition characteristics of the common mode choke coil 1 and a rise in temperature of the common mode choke coil 1. In the experiment for the DC superposition characteristics of the common mode choke coil, current values of the transmission signals Sig11 and Sig12 were examined for drop of 30% in a common mode impedance value of the common mode choke coil 1 from an initial value (a common mode impedance value when the current values of the transmission signals Sig11 and Sig12 are approximately 0 A). In the experiment for the rise in temperature of the common mode choke coil, the current values of the transmission signals Sig11 and Sig12 were examined for an increase of 30° C. from an initial value (room temperature) of the common mode impedance value of the common mode choke coil 1.

Other conditions are as described below. Note that in the first experiment, the plate-shaped top plate core 90 was disposed upon the flange portion 16 and the flange portion 18, as illustrated in FIG. 5:

core 12: left-right length, approx. 3.2 mm; front-back width, approx. 2.5 mm; top-bottom height, approx. 1.5 mm, top plate core 90: left-right length, approx. 3.2 mm; front-back width, approx. 2.5 mm; top-bottom height, approx. 1.5 mm, relative permeability of material of core 12 and top plate core 90: approx. 1000 (Ni—Zn-based ferrite), effective saturation magnetic flux density: approx. 350 mT (at approx. 1 kHz), gap between top plate core 90 and flange portions 16 and 18: no less than approx. 2 μm and no more than approx. 5 μm, and diameter of windings 32, 34, and 36: approx. 50 μm.

Figure 6:
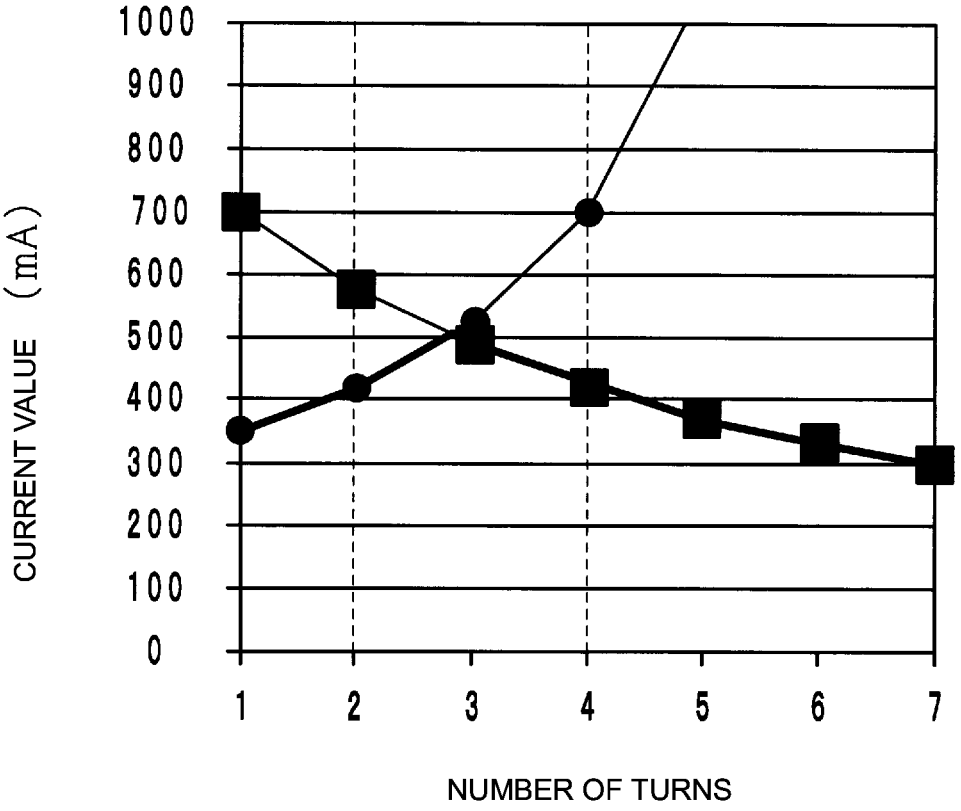
FIG. 6 is a graph illustrating experiment results.

FIG. 6 is a graph illustrating experiment results. The vertical axis represents the current value and the horizontal axis represents the number of turns. In FIG. 6, squares indicate experiment results for the rise in temperature of the common mode choke coil 1, and circles indicate experiment results for the DC superposition characteristics of the common mode choke coil 1.

In FIG. 6, the lower of the current value in the experiment for the DC superposition characteristics and the current value in the experiment for the rise in temperature corresponds to the rated current value. As such, in FIG. 6, the area indicated by a bold line represents the rated current value.

According to FIG. 6, in the case where the number of turns in the windings 32, 34, and 36 is seven (in other words, in the case of the same configuration as the common mode choke coil 110), the rated current value is approximately 300 mA. However, when the number of turns of the winding 34 is less than the number of turns in the windings 32 and 36, the rated current value increases. In particular, the rated current value is greater than or equal to approximately 400 mA in the case where the number of turns in the winding 34 is no less than two and no more than four, for an increase of approximately 30% or more than the rated current value of the common mode choke coil 110 (approximately 300 mA). Accordingly, it is preferable for the number of turns in the winding 34 to be no less than two and no more than four in the case where the number of turns of the windings 32 and 36 is seven.

Here, the inventors of the present disclosure carried out the following second experiment in order to find a preferable range for a value of a ratio of the number of turns in the winding 34 to the number of turns in the windings 32 and 36 (a turn number ratio). Specifically, the inventors of the present disclosure varied the number of turns in the winding 34 from zero to 20 while keeping the number of turns of the windings 32 and 36 at seven, and examined the DC superposition characteristics of the common mode choke coil 1 and a rise in temperature of the common mode choke coil 1. In the experiment for the DC superposition characteristics of the common mode choke coil, current values of the transmission signals Sig11 and Sig12 were examined for drop of 30% in the common mode impedance of the common mode choke coil 1 from an initial value (a common mode impedance value when the current values of the transmission signals Sig11 and Sig12 are approximately 0 A). In the experiment for the rise in temperature of the common mode choke coil, the current values of the transmission signals Sig11 and Sig12 were examined for an increase of 30° C. from an initial value (room temperature) of the common mode impedance of the common mode choke coil 1. Conditions of the common mode choke coil 1 in the second experiment are the same as in the first experiment, and thus descriptions thereof will be omitted.

Figure 7:
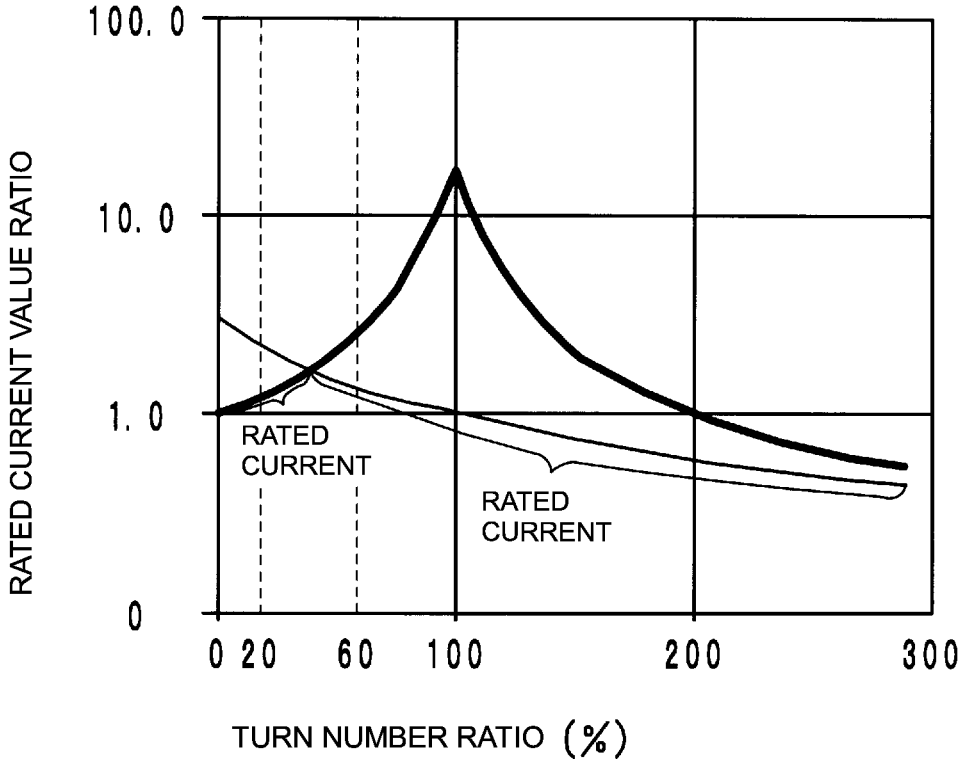
FIG. 7 is a graph illustrating experiment results.

FIG. 7 is a graph illustrating experiment results. The vertical axis represents a rated current value ratio and the horizontal axis represents the turn number ratio. The rated current value ratio is a value obtained by dividing the rated current value by the rated current value when the number of turns in the winding 34 is zero (in other words, when only the windings 32 and 36 are present). Meanwhile, the turn number ratio is a value of a ratio of the number of turns in the winding 34 to the number of turns in the winding 32 or the winding 36. In FIG. 7, a thin line indicates experiment results for the rise in temperature of the common mode choke coil 1, and a thick line indicates experiment results for the DC superposition characteristics of the common mode choke coil 1.

According to FIG. 7, it can be seen that in a range where the turn number ratio is no less than approximately 20% and no more than approximately 60%, the rated current value is increased by no less than approximately 30% compared to the rated current value of the common mode choke coil 110. Thus according to the experiments, it is preferable that the turn number ratio is no less than approximately 20% and no more than approximately 60%. This makes it possible to achieve an increase in the rated current value.

Note that in FIG. 7, the lower of the current value in the experiment for the DC superposition characteristics and the current value in the experiment for the rise in temperature corresponds to the rated current value.

In addition, according to the common mode choke coil 1, insertion loss (Scc21) of the common mode signal can be increased. More specifically, according to the common mode choke coil 1, a stray capacitance formed between the winding 34 and the windings 32 and 36 is lower in the case where the number of turns in the winding 34 is lower than the number of turns in the windings 32 and 36. Accordingly, the insertion loss of the common mode signal can be increased. In other words, according to the common mode choke coil 1, the common mode signal can be effectively removed.

Figure 8:
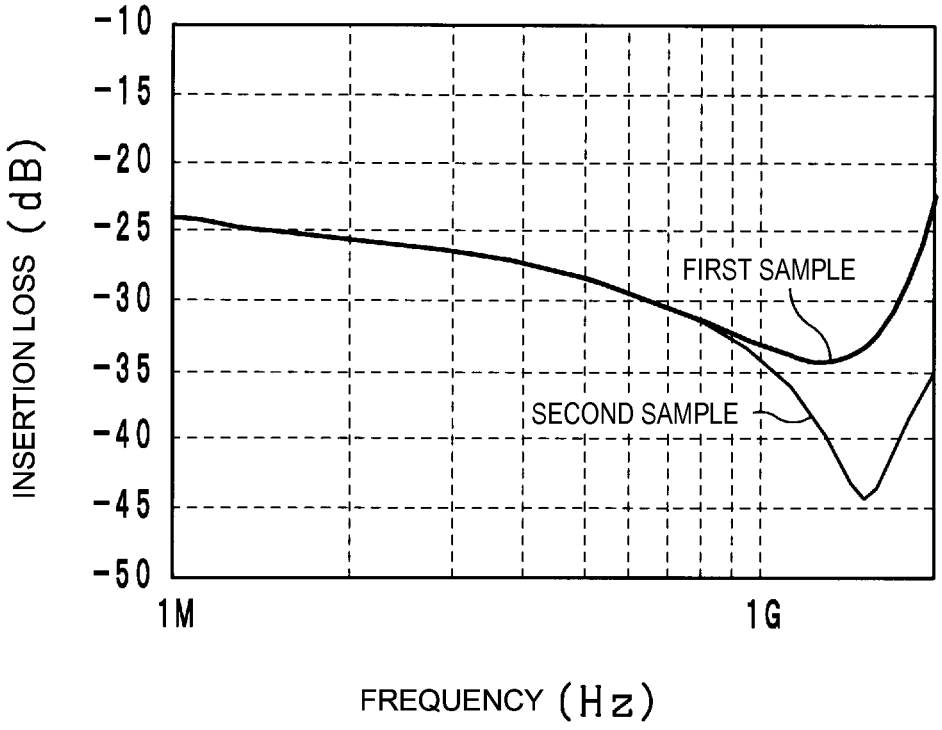
FIG. 8 is a graph illustrating experiment results.
Figure 9:
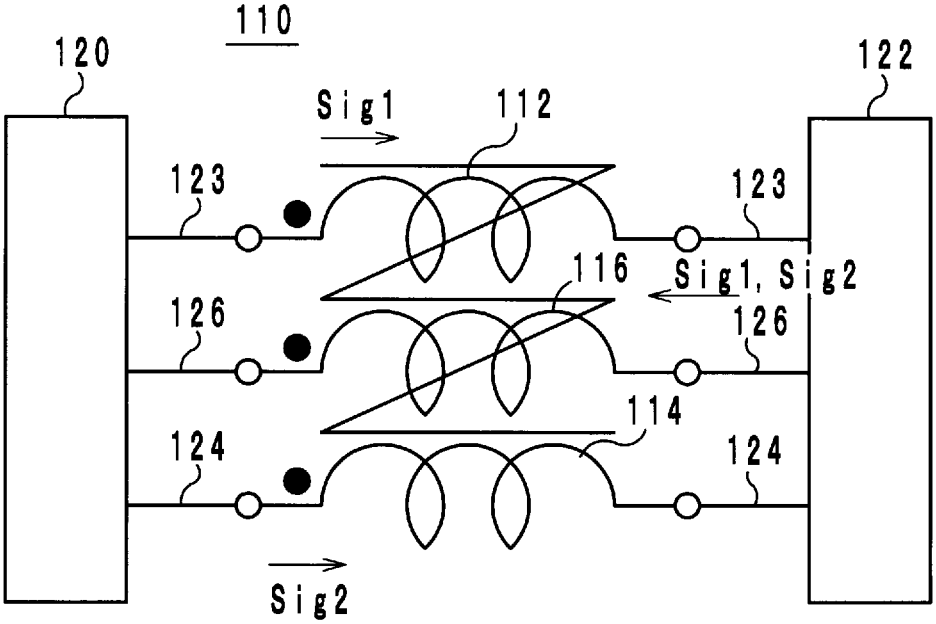
FIG. 9 PRIOR ART
FIG. 9 is a circuit diagram illustrating a transmission/reception system in which a wound-type common mode choke coil disclosed in Japanese Patent No. 3952971 is applied.

Here, the inventors of the present disclosure carried out a third experiment, described below, in order to confirm that the insertion loss (Scc21) of the common mode signal in the common mode choke coil 1 is greater than the insertion loss (Scc21) in the common mode choke coil 110. Specifically, the inventors created a common mode choke coil in which the number of turns in the windings 32, 34, and 36 is seven (a "first sample" hereinafter) and a common mode choke coil in which the number of turns in the windings 32 and 36 is seven and the number of turns in the winding 34 is four (a "second sample" hereinafter). The insertion loss (Scc21) was then measured in the first sample and the second sample. FIG. 8 is a graph illustrating experiment results. The vertical axis indicates the insertion loss, and the horizontal axis indicates a frequency. The insertion loss Scc21 is a value of a ratio of a common mode signal outputted from the outer electrode 46 connected to the winding 34 to a common mode signal inputted from the outer electrode 40 connected to the winding 32, when the outer electrodes 42 and 48 connected to both ends of the winding 34 are open.

According to FIG. 8, it can be seen that the second sample has a greater loss than the first sample in frequencies higher than approximately 1 GHz. Accordingly, the common mode choke coil 1 can increase the insertion loss (Scc21) of the common mode signal.

In addition, the common mode choke coil 1 can suppress a rise in temperature. More specifically, a current flowing in the winding 34 is greater than currents flowing in the windings 32 and 36, respectively. Accordingly, a current flowing in the outer electrode 42 connected to the winding 34 is greater than currents flowing in the outer electrodes 40 and 44 connected to the windings 32 and 36, respectively. In other words, in the case where the surface area of the outer electrode 42 is the same as the surface area of the outer electrodes 40 and 44, an amount of heat emitted by the outer electrode 42 becomes greater than an amount of heat emitted by the outer electrodes 40 and 44.

Accordingly, the surface area of the outer electrode 42 connected to the winding 34 is greater than the surface area of the outer electrodes 40 and 44 connected to the windings 32 and 36, respectively. As such, the resistance value of the outer electrode 42 is lower than the resistance value of the outer electrodes 40 and 44. As a result, the amount of heat emitted by the outer electrode 42 decreases, and a rise in temperature in the common mode choke coil 1 is suppressed. Note that the outer electrode 48 has a greater surface area than the surface area of the outer electrodes 46 and 50 for the same reason.

Other Embodiments

The common mode choke coil according to the present disclosure is not limited to the common mode choke coil 1, and many variations can be made thereon without departing from the scope and spirit of the disclosure.

The number of turns in the winding 32 and the number of turns in the winding 36 need not be the same number.

In addition, the surface area of the outer electrode 42 need not be greater than the surface area of the outer electrodes 40 and 44. Likewise, the surface area of the outer electrode 48 need not be greater than the surface area of the outer electrodes 46 and 50.

As described above, the present disclosure is useful in common mode choke coils, and is particularly advantageous in that a rated current value can be increased.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

The invention claimed is:

1. A common mode choke coil comprising:

a core;

a first flange portion disposed on a first side of the core and a second flange portion disposed on a second side of the core that is opposite to the first side, each flange portion including three electrode forming regions aligned along a bottom surface of the respective flange portion in a first direction, and at least one electrode forming region of each respective three electrode forming regions is positioned at a center of the respective flange portion along the first direction; and a first winding, a second winding, and a third winding that are wrapped around the core, wherein a number of turns in the third winding being less than a number of turns in the first winding and a number of turns in the second winding, such that the resistance of the third winding is lower than the resistances of each of the first and second windings, and a turn number ratio, which is a ratio of the number of turns in the third winding to the number of turns in the first winding and/or the number of turns in the second winding, is greater than 20% and less than 60%.

2. The common mode choke coil according to claim 1, wherein the number of turns in the first winding is the same as the number of turns in the second winding.

3. The common mode choke coil according to claim 1, further comprising:

a first outer electrode and a second outer electrode connected to both ends of the first winding;

a third outer electrode and a fourth outer electrode connected to both ends of the second winding; and a fifth outer electrode and a sixth outer electrode connected to both ends of the third winding, wherein a surface area of the fifth outer electrode is greater than a surface area of the first outer electrode and a surface area of the third outer electrode.

* * * * *